US006810712B2

(12) United States Patent
Goto

(10) Patent No.: US 6,810,712 B2
(45) Date of Patent: Nov. 2, 2004

(54) SPLIT DIE AND DIE NIB DEFINED BY THE SAME

(75) Inventor: Yoshihide Goto, Yamagata (JP)

(73) Assignee: Goto Electronic Co., Ltd., Yamagata (JP)

( * ) Notice: Subject to any disclaimer, the term of this patent is extended or adjusted under 35 U.S.C. 154(b) by 0 days.

(21) Appl. No.: 10/214,010

(22) Filed: Aug. 7, 2002

(65) Prior Publication Data

US 2003/0136171 A1 Jul. 24, 2003

(30) Foreign Application Priority Data

Jan. 23, 2002 (JP) ..... 2002-13917

(51) Int. Cl.[7] ..... B21C 3/12
(52) U.S. Cl. ..... 72/467
(58) Field of Search ..... 72/467, 468

(56) References Cited

U.S. PATENT DOCUMENTS 686,365 A * 11/1901 Thackray ..... 72/468
1,924,734 A * 8/1933 Brown ..... 72/467
2,101,689 A * 12/1937 Richardson ..... 72/468
2,846,056 A * 8/1958 Hampton ..... 72/467
3,628,449 A * 12/1971 Phillips, Jr. ..... 72/468

FOREIGN PATENT DOCUMENTS

| | | | | |
|---|---|---|---|---|
| DE | 844136 | * | 7/1952 | 72/468 |
| GB | 467546 | * | 6/1937 | 72/468 |
| JP | 29735 | * | 12/1969 | 72/468 |

* cited by examiner

*Primary Examiner*—Daniel C. Crane
(74) *Attorney, Agent, or Firm*—Reising, Ethington, Barnes, Kisselle, P.C.

(57) ABSTRACT

A split die includes a plurality of die pieces which can be assembled into a die nib. The die nib defines a central wire forming passage which has a cross section of a substantially rectangular shape or a square. The cross section of the wire forming passage is progressively smaller such that the wire forming passage has a predetermined approach angle. Each of the die pieces has a passage segment of a generally triangular shape to partially define the wire forming passage. The die piece has a pair of side lines each passing a point on an axial center line of the wire forming passage.

7 Claims, 3 Drawing Sheets

SPLIT DIE AND DIE NIB DEFINED BY THE SAME

BACKGROUND OF THE INVENTION

1. Field of the Invention

The present invention relates to a split die and a die nib defined by the split die which is best used for a continuous drawing process of a fine wire having a generally rectangular or square section.

2. Related Art

For producing a wire having a generally rectangular or square section, a conventional method employs a cutter to cut a sheet made of an electrically conductive material and having a desirable thickness such that the wire has a sectional width generally equal to the thickness.

However, the cutter of the conventional method can not provide a square section wire having a desired strength, which causes a break of the wire, resulting in a disadvantage such as a worse product acceptance percentage thereof. Furthermore, a sheet material used for producing a square wire has a limited length so that the square wire is not sufficient in length.

For producing a round wire, a drawing process employs a die formed with a round wire forming passage, and the forming passage is progressively smaller in section in an axial direction of the die.

On the other hand, a precise forming art such as laser processing and electric charge machining has been developed, and application techniques of a synthetic diamond have also remarkably developed. Thus, such a precise forming art can employ sintered synthetic diamonds used for defining fine forming apertures having various shapes to draw fine wires.

The aforementioned conventional method employing the cutter can not produce a long, square section wire, because the sheet material does not have a strength enough to be well cut by the cutter. Thus, the conventional method is unsuitable for producing a square section wire and achieves a less productivity with a less product acceptance percentage.

Furthermore, there has been recently a need for a fine wire having a square section. Thus, a forming tool for producing such a square section fine wire has been also needed.

SUMMARY OF THE INVENTION

To overcome the disadvantage of the conventional method, an object of the present invention is to provide a split die defining a die nib which enables continuous production of a square section fine wire having a sufficient strength to cause less breaks of the wire. The split die attains an improved productivity with a better product acceptance percentage of the wire, allowing a mass production of wire products improved in precision and quality. The split die is easy in handling, parts replacement, and maintenance thereof, resulting in a less manufacturing cost thereof.

For achieving the object, a first aspect of the invention is a split die comprising a plurality of die pieces which can be assembled into a die nib. The die nib defines a central wire forming passage having a cross section of a substantially rectangular shape or a square. The cross section of the wire forming passage is progressively smaller such that the wire forming passage has a predetermined approach angle. Each of the die pieces has a passage segment of a generally triangular shape to partially define the wire forming passage. The die piece has a pair of side lines each passing a point on an axial center line of the wire forming passage.

Thus, the die nib enables continuous production of a square section fine wire having a sufficient strength to cause less breaks of the wire. The split die attains an improved productivity with a better product acceptance percentage of the wire, allowing a mass production of wire products improved in precision and quality. The split die is easy in handling, parts replacement, and maintenance thereof, resulting in a less manufacturing cost thereof.

Preferably, the split die further includes a die holder formed with a receiver recess and a cover plate to cover the receiver recess. Each of the die pieces can be removably received in the receiver recess and the die holder is formed with an inlet opening upstream contiguous with the receiver recess. The cover plate is formed with a material inlet opening communicating with the wire forming passage. The cover plate is removably fitted on a front surface of the die holder.

Thus, the separated die pieces can be easily secured in and removed from the die holder, and the die pieces are easy in partial replacement and maintenance thereof.

Preferably, the cross section of the wire forming passage has two pairs of side edges, and one of each pair of the side edges has a length substantially equal to the other.

Thus, a fine, precise wire forming passage can be obtained. The wire forming passage allows continuous drawing of a square section fine wire without a break or a damage of the wire.

Preferably, the cover plate has a downstream surface formed with a plurality of positioning pins projecting from the downstream surface, and each of the positioning pins is removably inserted into a corresponding cut-out hole or a positioning hole which is formed in the die piece for positioning the die pieces in the receiver recess.

This enables a quick, sure positioning of the separated die pieces received in the recess of the die holder.

Preferably, the die holder is provided with a pushing screw adjustably screwed into the die holder and the pushing screw has a leading end to push one of the die pieces in a lateral direction of the die piece with in the receiver recess.

This enables precise position adjustments of the separate die pieces received in the recess of the die holder to accurately position the die pieces in a predetermined manner.

Preferably, the wire forming passage has at least one of a bell angle portion and a reduction angle portion, the bell angle portion being upstream contiguous with the approach angle portion, the reduction angle portion being downstream contiguous with the approach angle portion.

This enables a continuous drawing process of a square section fine wire in accordance with material properties of the wire such as hardness, tensile strength, compression strength, fatigue strength, a friction coefficient, and a thermal elongation coefficient thereof.

Preferably, the die nib has a profile of a rectangle, a hexagon, or an octagon.

This enables a easy, precise manufacturing of the separate die pieces which are assembled to define a fine, precise wire forming passage. The wire forming passage allows a continuous drawing process of a square section fine wire.

Preferably, the wire forming passage is defined such that a fine wire having a rectangular section of a 0.04 to 0.10 mm width can be drawn through the wire forming passage.

Preferably, the wire forming passage has a cross section having four corners each of which has a curvature radius of about 0.01 mm.

Thus, the wire forming passage allows a continuous drawing process of a generally rectangular or square section fine wire.

Another aspect of the present invention is a die nib comprising a plurality of die pieces which can be assembled into the die nib, wherein the die nib defines a central wire forming passage having a cross section of a substantially rectangle shape or a square. The cross section of the wire forming passage is progressively smaller such that the wire forming passage has a predetermined approach angle, each of the die pieces defining a passage segment of a generally triangular shape to partially define the wire forming passage. The die piece has a pair of side lines each passing a point on an axial center line of the wire forming passage.

DETAILED DESCRIPTION OF THE PREFERRED EMBODIMENTS

Referring to the accompanied drawings, embodiments of the present invention will be discussed hereinafter.

FIGS. 1 to 5 show a first embodiment of the present invention, which has a die nib divided into four separate dies.

Figure 4:
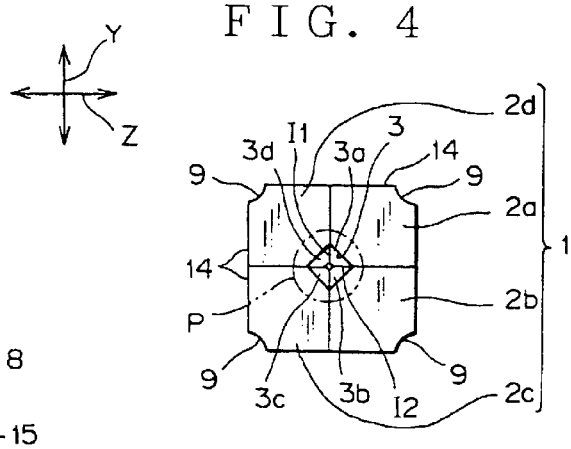
FIG. 4 is a front view showing a die nib of the first embodiment.
Figure 1:
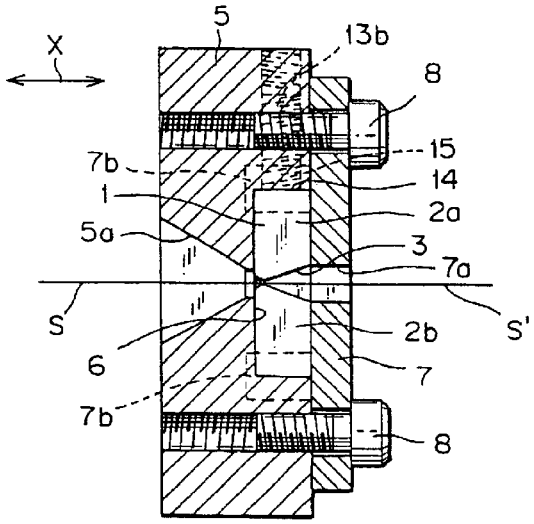
FIG. 1 is a sectional view showing a first embodiment of a split die according to the present invention.
Figure 2:
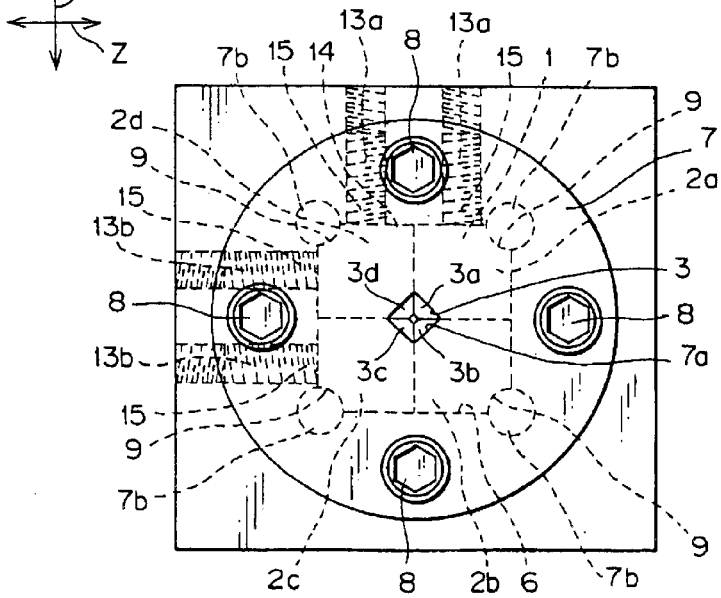
FIG. 2 is a front view showing the split die of the first embodiment.

Reference numeral designates a die nib divided into four die pieces 2*a*, 2*b*, 2*c*, and 2*d* by two diagonal lines 11 and 12 perpendicular to each other of a wire forming passage 3 (discussed later) as illustrated in FIGS. 2 and 4. Each of the die pieces 2*a*, 2*b*, 2*c*, and 2*d* has a generally triangular inlet passage segment 3*a*, 3*b*, 3*c*, or 3*d* which is divided by the diagonal lines 11 and 12. The triangular passage segments 3*a*, 3*b*, 3*c*, and 3*d* define a wire forming passage 3 having an approach angle of a predetermined angle á so as to be progressively smaller in section in an axial direction X when the die pieces are assembled into the die nib 1. The wire forming passage 3 has a generally rectangular or square section as illustrated in FIGS. 2 and 4.

Since the wire forming passage 3 having a generally rectangular or square section is divided into the triangular inlet passage segments 3*a*, 3*b*, 3*c*, and 3*d* by the diagonal lines 11 and 12, each of the passage segments 3*a*, 3*b*, 3*c*, and 3*d* can be formed precisely to define the wire forming passage 3 which enables a fine wire forming process with a high finishing accuracy.

The four separate die pieces 2*a*, 2*b*, 2*c*, and 2*d* are removably received in a receiver recess 6 formed in a front surface of a die holder 5. The die holder 5 has a wire outlet opening 5*a* contiguous with the receiver recess 6.

Reference numeral 7 designates a cover plate 7 formed with a wire material inlet opening 7*a* continuous to the wire forming passage 3 communicating with a wire forming passage 3. The cover plate 7 is removably fitted on the front surface of the die holder 5 to close the die holder 5 so that the die pieces 2*a*, 2*b*, 2*c*, and 2*d* are integratedly enclosed in the receiver recess 6 of the die holder 5. In the illustrated embodiment, the cover plate 7 is secured on the die holder 5 by screwing a suitable number, e.g. four of securing bolts 8 into the die holder 5. The cover plate 7 has a predetermined number (four in the embodiment) of positioning pins 7*b* projecting therefrom such that the pins are each removably received in a corresponding hole 9 formed in the die piece 2*a*, 2*b*, 2*c*, or 2*d* for positioning the die pieces 2*a*, 2*b*, 2*c*, and 2*d* within the receiver recess 6 of the die holder 5.

However, another arrangement of holes 9 maybe possible in the die pieces 2*a*, 2*b*, 2*c* and 2*d*.

The wire forming passage 3 enables a drawing process of a fine wire S having a generally rectangular or square section of a 0.04 to 0.10 mm width. The wire forming passage 3 is divided into the generally triangular passage segments 3*a*, 3*b*, 3*c*, and 3*d* (FIGS. 2, 4, and 5) when the die nib 1 is separated into the die pieces 2*a*, 2*b*, 2*c*, and 2*d* along the diagonal lines I1 and I2. The passage segments 3*a*, 3*b*, 3*c*, and 3*d* are formed by a precise forming method such as a process utilizing laser or electric arc. Each passage segment 3*a*, 3*b*, 3*c*, or 3*d* has a top angle θ1, θ2, θ3, or θ4 opposed to a base 10. The bases 10 of the passage segments 3*a*, 3*b*, 3*c*, and 3*d* each have a length 11 substantially equal to each other. Each passage segment 3*a*, 3*b*, 3*c*, or 3*d* has a pair of bottom angles θ1-1 and θ1-2, and the bottom angle θ1-1 of one of the passage segments 3*a*, 3*b*, 3*c*, and 3*d* is adjacent to the bottom angle θ1-2 of another of the passage segments 3*a*, 3*b*, 3*c*, and 3*d*.

As illustrated in the drawings of the embodiment, the wire forming passage 3 has the approach angle á portion for drawing of the square wire S from a wire material S'. The wire forming passage 3 has further a bell angle portion of a predetermined angle β in an upstream side of the approach angle á portion for smoothly feeding the wire material S' at a high speed. The wire forming passage 3 has further a reduction angle portion of a predetermined angle γ in a downstream side of the approach angle á portion for an adjustment forming process after the drawing of the wire material S'. However, the wire forming passage 3 may have any combination of an approach angle á portion, a bell angle β portion, and a reduction angle γ portion in place of the above-mentioned arrangement. The approach angle á is suitably determined in accordance with material properties of the wire material S' such as hardness, tensile strength, compression strength, fatigue strength, a friction coefficient, and a thermal elongation coefficient of the wire material S'. The bell angle β is larger than the approach angle á while the approach angle á is larger than the reduction angle γ.

The die nib 1 which is defined by combining the die pieces 2*a*, 2*b*, 2*c* and 2*d* has a generally rectangular or square (as illustrated) front profile. To obtain the wire forming passage 3 with a high precision finish, each passage segment 3*a*, 3*b*, 3*c*, or 3*d* is easily formed by a precise forming method such as a cutting process utilizing laser or electric arc. Thus, a fine wire S having a square section, e.g. of a 0.04 to 0.10 mm width can be successfully made from the wire material S' by a continuous drawing process employing the die nib 1. Furthermore, the wire forming passage 3 has four corners 11 each of which is a curved surface 12 having a curvature radius R of about 0.01 mm, which is enough to define a fine wire S having a high precision square section by the drawing process.

Reference numerals 13*a* and 13*b* each designate a pushing screw screwed into one of two side surfaces 14 perpendicular to each other of the die holder 5. Each pushing screw 13*a* or 13*b* has a leading end 15 facing the receiver recess 6 so as to push the die piece 2*a*, 2*b*, 2*c* or 2*d* for a precise position adjustment of the die pieces within the receiver recess 6 in longitudinal and lateral directions Y and Z.

For producing a fine wire S having a square section by employing the die nib 1 of thus configured first embodiment, first, the four separated die pieces 2*a*, 2*b*, 2*c* and 2*d* are inserted into the receiver recess 6 of the die holder 5 to define the die nib 1. Next, the cover plate 7 covers the receiver recess 6, and the securing bolts 8 are screwed into the die holder 5 so as to secure the cover plate 7 on the die holder 5. Thus, the die pieces 2*a*, 2*b*, 2*c* and 2*d* are integratedly enclosed in the receiver recess 6 of the die holder 5.

At the same time, the four positioning pins 7*b* projected toward the receiver recess 6 from the cover plate 7 are engaged with the corresponding holes 9 of the die pieces 2*a*, 2*b*, 2*c* and 2*d* for positioning the die pieces within the receiver recess 6.

After the mounting and positioning of the die pieces 2*a*, 2*b*, 2*c* and 2*d* in the receiver recess 6 of the die holder 5, the pushing screws 13*a* and 13*b* are screwed forward or backward in the side surfaces 14 of the die holder 5 in the direction Y or Z such that the leading ends 15 of the pushing screws 13*a* and 13*b* abut against the die pieces 2*a*, 2*b*, 2*c* and 2*d*. Thus, a final precise position adjustment of the die pieces 2*a*, 2*b*, 2*c* and 2*d* within receiver recess 6 can be attained.

Then, the wire material S' is supplied from the wire material inlet opening 7*a* formed in the cover plate 7 into the wire forming passage 3 for drawing thereof.

Figure 3:
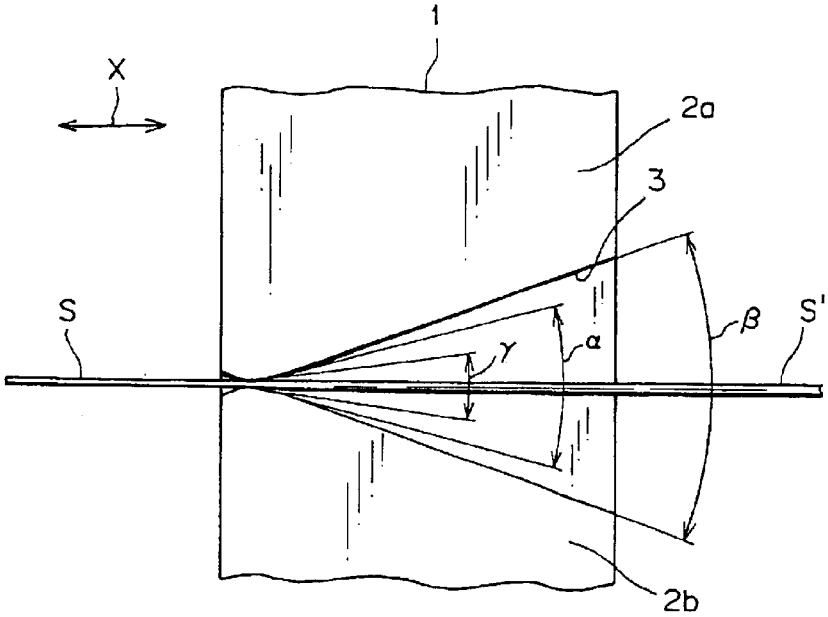
FIG. 3 is an enlarged side view showing a wire forming passage defined by a plurality of die pieces of the first embodiment.
Figure 5:
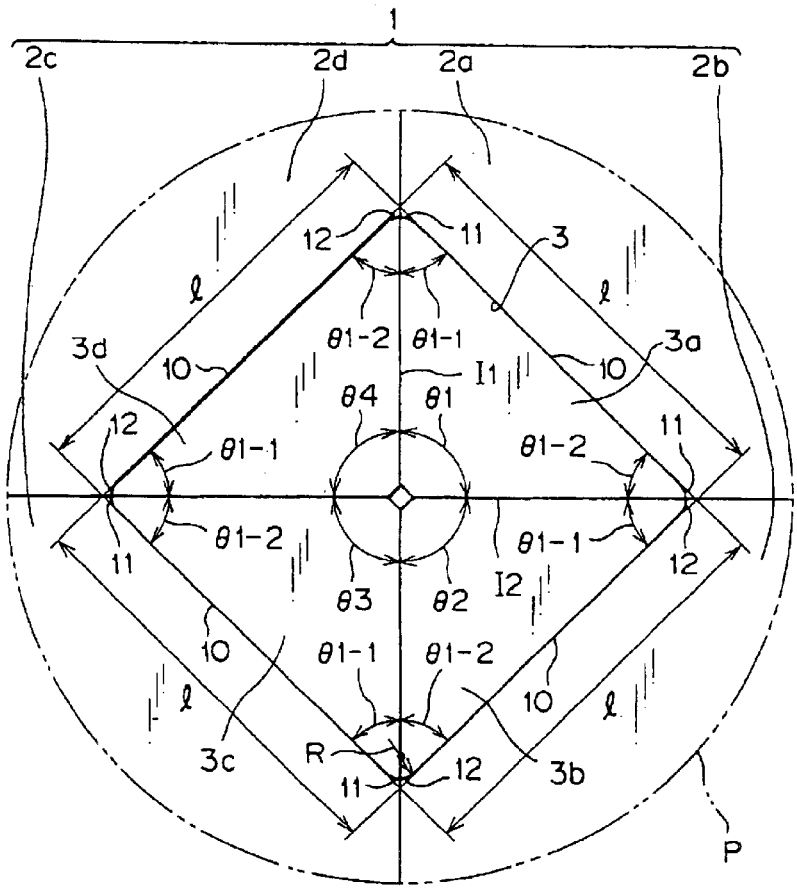
FIG. 5 is an enlarged front view of the wire forming passage for showing a part surrounded by a circle P of FIG. 4.

The wire forming passage 3 of the embodiment has the bell angle β portion continuous with the wire material inlet opening 7*a* as illustrated in FIG. 3 so that the wire material S' is quickly smoothly introduced into the wire forming passage 3 via the bell angle β portion. Then, the wire material S' is drawn into the approach angle á portion continuous with the bell angle β portion.

Since the reduction angle γ portion is positioned directly downstream of the approach angle á portion so that the wire S can be finished in the section shape of a square fine wire continuously drawn from the wire outlet opening 5*a*.

Figure 6:
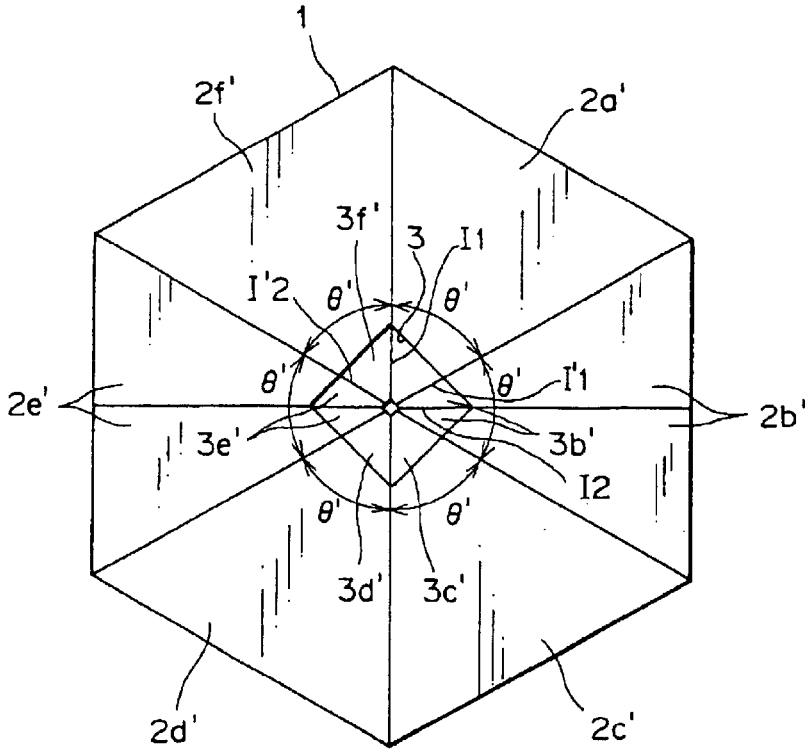
FIG. 6 is an enlarged front view showing a wire forming passage related to a second embodiment of the present invention.

FIG. 6 shows a second embodiment of the present invention, in which a die nib 1 has a front profile of a hexagon. The die nib 1 is divided along diagonal lines I1 and I2 perpendicular to each other and is further divided along lines I'1 and I'2 crossing to each other at 60° to obtain eight separate die pieces 2*a*', 2*b*', 2*b*', 2*c*', 2*d*', 2*e*', 2*e*', and 2*f*. The line I'1 crosses with the diagonal line I1 at a predetermined angle θ' of 60°.

Each die piece 2*a*', 2*b*', 2*b*', 2*c*', 2*d*', 2*e*', 2*e*', or 2*f*' has a generally triangular shape 3*a*', 3*b*', 3*b*', 3*c*' 3*d*', 3*e*', 3*e*', or 3*f*' to define a wire forming passage 3 having a progressively smaller section. The wire forming passage 3 has an approach angle á at an upstream side thereof. The die nib 1 having the eight separate die pieces is advantageous to precisely form the passage segments 3*a*', 3*b*', 3*b*', 3*c*', 3*d*', 3*e*', 3*e*', and 3*f*'. When any one of the die pieces 2*a*', 2*b*', 2*c*', 2*d*', 2*e*', and 2*f*' has developed wear or a defect, the die piece can be easily replaced by a new one with a less cost.

Figure 7:
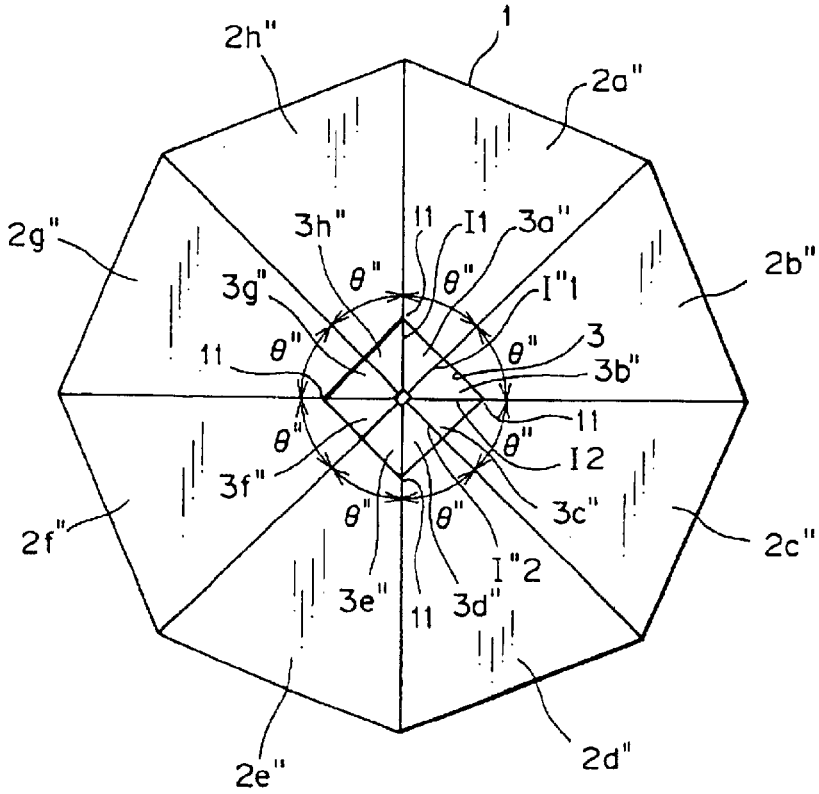
FIG. 7 is an enlarged front view showing a wire forming passage related to a third embodiment of the present invention.

FIG. 7 shows a third embodiment of the present invention, in which a die nib 1 has a front profile of an octagon. The die nib 1 is divided along diagonal lines 11 and 12 perpendicular to each other and is further divided along diagonal lines I"1 and I"2 to obtain eight separate die pieces 2*a*", 2*b*", 2*c*", 2*d*", 2*e*", 2*f*", 2*g*", and 2*h*". Each line I"l or I"2 crosses with the diagonal lines I1 and I2 at a predetermined angle θ" of 45°.

Each die piece 2*a*", 2*b*", 2*c*", 2*d*", 2*e*", 2*f*", 2*g*", or 2*h*" has a generally triangular passage segment 3*a*", 3*b*", 3*c*", 3*d*", 3*e*", 3*f*", 3*g*", or 3*h*" to define a wire forming passage 3 having a progressively smaller section. The wire forming passage 3 has an approach angle á at an upstream side thereof. The die nib 1 having the eight separate die pieces is advantageous to precisely form the passage segment 3*a*", 3*b*", 3*c*", 3*d*", 3*e*", 3*f*", 3*g*", or 3*h*". When any one of the die piece 2*a*", 2*b*", 2*c*", 2*d*", 2*e*", 2*f*", 2*g*", and 2*h*" has developed wear or a defect, the die piece can be easily replaced by a new one with a less cost.

What is claimed is:

1. A split die comprising a plurality of die pieces which can be assembled into a die nib, wherein the die nib defines a central wire forming passage having a cross section of a substantially rectangular shape or a square, the cross section of the wire forming passage being progressively smaller such that the wire forming passage has a predetermined approach angle, each of the die pieces defining a passage segment of a generally triangular shape to partially define the wire forming passage, the die piece having a pair of side lines, said side lines establishing imaginary lines which pass through an axial center line of the wire forming passage, a die holder formed with a receiver recess and a cover plate to cover the receiver recess, wherein each of the die pieces can be removably received in the receiver recess and the die holder is formed with an inlet opening upstream contiguous with the receiver recess, the cover plate formed with a material inlet opening communicating with the wire forming passage, the cover plate removably fitted on a front surface of the die holder, wherein the cover plate has a downstream surface formed with a plurality of positioning pins projecting from the downstream surface, and each of the positioning pins is removably inserted into a corresponding cut-out hole or a positioning hole which is formed in the die piece for positioning the die pieces in the receiver recess.

2. The split die as claimed in claim 1 wherein the cross section of the wire forming passage has two pairs of side edges, and one of each pair of the side edges has a length substantially equal to the other.

3. The split die as claimed in claim 1 wherein the die holder is provided with a pushing screw adjustably screwed into the die holder and the pushing screw has a leading end to push one of the die pieces in a lateral direction of the die piece with in the receiver recess.

4. The split die as claimed in claim 1 wherein the wire forming passage has at least one of a bell angle portion and a reduction angle portion, the bell angle portion being upstream contiguous with the approach angle portion, the reduction angle portion being downstream contiguous with the approach angle portion.

5. The split die as claimed in claim 1 wherein the die nib has a profile of a rectangle, a hexagon, or an octagon.

6. The split die as claimed in claim 1 wherein the wire forming passage is defined such that a fine wire of a rectangular section having a 0.04 to 0.10 mm width can be drawn through the wire forming passage.

7. The split die as claimed in claim 1 wherein the wire forming passage has a section having four corners each of which has a curvature radius of about 0.01 mm.

* * * * *